US008672020B2

(12) United States Patent
Chen et al.

(10) Patent No.: US 8,672,020 B2
(45) Date of Patent: Mar. 18, 2014

(54) METHOD FOR PRODUCING ALUMINUM-ZIRCONIUM-CARBON INTERMEDIATE ALLOY

(75) Inventors: Xuemin Chen, Guangdong (CN); Qingdong Ye, Guangdong (CN); Yueming Yu, Guangdong (CN); Jianguo Li, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 303 days.

(21) Appl. No.: 13/141,496

(22) PCT Filed: Apr. 23, 2011

(86) PCT No.: PCT/CN2011/073217

§ 371 (c)(1), (2), (4) Date: Jun. 22, 2011

(87) PCT Pub. No.: WO2012/027992

PCT Pub. Date: Mar. 8, 2012

(65) Prior Publication Data

US 2011/0308758 A1 Dec. 22, 2011

(30) Foreign Application Priority Data

Mar. 15, 2011 (CN) ..... 2011 1 0060734

(51) Int. Cl.

| | |
|---|---|
| ***B22D 11/00*** | (2006.01) |
| ***B22D 27/02*** | (2006.01) |
| ***B22D 11/10*** | (2006.01) |
| ***C22C 21/00*** | (2006.01) |

(52) U.S. Cl.

USPC ..... 164/462; 164/468; 164/473; 420/552

(58) Field of Classification Search

USPC ..... 164/47, 492, 71.1, 498, 499, 466–468, 164/473, 462; 420/552

See application file for complete search history.

(56) References Cited

U.S. PATENT DOCUMENTS

| | | | | |
|---|---|---|---|---|
| 4,748,001 | A * | 5/1988 | Banerji et al. | 420/528 |
| 7,615,125 | B2 * | 11/2009 | Bes et al. | 148/552 |

* cited by examiner

*Primary Examiner* — Kevin P Kerns
*Assistant Examiner* — Steven Ha
(74) *Attorney, Agent, or Firm* — Jackson IPG PLLC

(57) ABSTRACT

The present invention discloses a method for producing an aluminum-zirconium-carbon (Al—Zr—C) intermediate alloy; the Al—Zr—C intermediate alloy has a chemical composition of 0.01% to 10% Zr, 0.01% to 0.3% C, and Al in balance; the producing method comprising the steps of: producing commercially pure aluminum, zirconium metal, and graphite material according to the weight percentages of the aluminum-zirconium-carbon intermediate alloy; the graphite is graphite powder having an average particle size of 0.074 mm to 1 mm; and the graphite powder is subjected to the following treatments: being added to the aqueous solution of KF, NaF, K2ZrF6, K2TiF6 or the combination thereof, soaked for 12 to 72 hours, filtrated or centrifuged, and dried at 80° C. to 200° C. for 12 to 24 hours; melting the commercially pure aluminum and keeping it at 700° C. to 900° C. to provide aluminum liquid, in which the prepared zirconium and the treated graphite powder are added and melted to provide an alloy solution; and keeping the alloys solution at 700° C. to 900° C. under mechanical or electromagnetic agitation and performing casting molding. The present method produces a high-quality Al—Zr—C intermediate alloy in low cost.

16 Claims, No Drawings

METHOD FOR PRODUCING ALUMINUM-ZIRCONIUM-CARBON INTERMEDIATE ALLOY

FIELD OF THE INVENTION

The present invention relates to a method for producing an intermediate alloy as a grain refiner for improving the performance of metal and the alloys thereof, and especially, to a method for producing an aluminum-zirconium-carbon intermediate alloy for refining the grains of magnesium and magnesium alloys.

BACKGROUND OF THE INVENTION

The use of magnesium and magnesium alloy in industries started in 1930s. Since magnesium and magnesium alloys are the lightest structural metallic materials at present, and have the advantages of low density, high specific strength and stiffness, good damping shock absorption, heat conductivity, and electromagnetic shielding performance, excellent machinability, stable part size, easy recovery, and the like, magnesium and magnesium alloys, especially wrought magnesium alloys, possess extremely enormous utilization potential in the filed of transportation, engineering structural materials, and electronics. Wrought magnesium alloy refers to the magnesium alloy formed by plastic molding methods such as extruding, rolling, forging, and the like. However, due to the constraints in, for example, material preparation, processing techniques, anti-corrosion performance and cost, the use of magnesium alloy, especially wrought magnesium alloy, is far behind steel and aluminum alloys in terms of utilization amount, resulting in a tremendous difference between the developing potential and practical application thereof, which never occurs in any other metal materials.

The difference of magnesium from other commonly used metals such as iron, copper, and aluminum lies in that, its alloy exhibits closed-packed hexagonal crystal structure, has only 3 independent slip systems at room temperature, is poor in plastic wrought, and is significantly affected by grain sizes in terms of mechanical property. Magnesium alloy has relatively wide range of crystallization temperature, relatively low heat conductivity, relatively large volume contraction, serious tendency to grain growth coarsening, and defects of generating shrinkage porosity, heat cracking, and the like during setting. Since finer grain size facilitates reducing shrinkage porosity, decreasing the size of the second phase, and reducing defects in forging, the refining of magnesium alloy grains can shorten the diffusion distance required by the solid solution of short grain boundary phases, and in turn improves the efficiency of heat treatment. Additionally, finer grain size contributes to improving the anti-corrosion performance and machinability of the magnesium alloys. The application of grain refiner in refining magnesium alloy melts is an important means for improving the comprehensive performances and forming properties of magnesium alloys. The refining of grain size can not only improve the strength of magnesium alloys, but also the plasticity and toughness thereof, thereby enabling large-scale plastic processing and low-cost industrialization of magnesium alloy materials.

It was found in 1937 that the element that has significantly refining effect for pure magnesium grain size is Zr. Studies have shown that Zr can effectively inhibits the growth of magnesium alloy grains, so as to refine the grain size. Zr can be used in pure Mg, Mg—Zn-based alloys, and Mg—RE-based alloys, but can not be used in Mg—Al-based alloys and Mg—Mn-based alloys, since it has a very small solubility in liquid magnesium, that is, only 0.6 wt % Zr dissolved in liquid magnesium during peritectic reaction, and will be precipitated by forming stable compounds with Al and Mn. Mg—Al-based alloys are the most popular, commercially available magnesium alloys, but have the disadvantages of relatively coarse cast grains, and even coarse columnar crystals and fan-shaped crystals, resulting in difficulties in wrought processing of ingots, tendency to cracking, low finished product rate, poor mechanical property, and very low plastic wrought rate, which adversely affects the industrial production thereof. Therefore, the problem existed in refining magnesium alloy cast grains should be firstly addressed in order to achieve large-scale production. The methods for refining the grains of Mg—Al-based alloys mainly comprise overheating method, rare earth element addition method, and carbon inoculation method. The overheating method is effective to some extent; however, the melt is seriously oxidized. The rare earth element addition method has neither stable nor ideal effect. The carbon inoculation method has the advantages of broad source of raw materials and low operating temperature, and has become the main grain refining method for Mg—Al-based alloys. Conventional carbon inoculation methods add $MgCO_3$, $C_2Cl_6$, or the like to a melt to form large amount of disperse $Al_4C_3$ mass points therein, which are good heterogeneous crystal nucleus for refining the grain size of magnesium alloys. However, such refiners are seldom adopted because their addition often causes the melt to be boiled. In summary, in contrast with the industry of aluminum alloys, a general-purpose grain intermediate alloy has not been found in the industry of magnesium alloy, and the applicable range of various grain refining methods depends on the alloys or the components thereof. Therefore, one of the keys to achieve the industrialization of magnesium alloys is to design a general-purpose intermediate alloy capable of effectively refining cast grains when solidifying magnesium and magnesium alloys and a method capable of producing the intermediate alloy for grain refining in low cast and large scale.

SUMMARY OF THE INVENTION

In order to address the above problems existing at present, the present invention provides a method for producing aluminum-zirconium-carbon (Al—Zr—C) intermediate alloy, by which high-quality aluminum-zirconium-carbon (Al—Zr—C) intermediate alloy for refining the grains of magnesium and magnesium alloys can be continuously produced in low cost and large scale.

The present invention adopts the following technical solution: a method for producing an aluminum-zirconium-carbon (Al—Zr—C) intermediate alloy, characterized in that the aluminum-zirconium-carbon (Al—Zr—C) intermediate alloy has a chemical composition of 0.01% to 10% Zr, 0.01% to 0.3% C, and Al in balance, based on weight percentage; the producing method comprising the steps of:

a. preparing commercially pure aluminum, zirconium metal, and graphite material according to the weight percentages of the aluminum-zirconium-carbon intermediate alloy; the graphite is graphite powder having an average particle size of 0.074 mm to 1 mm; and the graphite powder is subjected to the following treatments: being added to the aqueous solution of KF, NaF, K2ZrF6, K2TiF6 or the combination thereof, soaked for 12 to 72 hours, filtrated or centrifuged, and dried at 80° C. to 200° C. for 12 to 24 hours;

b. melting the commercially pure aluminum and keeping it at 700° C. to 900° C. to provide aluminum liquid, in which the prepared zirconium and the treated graphite powder are added and melted to provide an alloy solution; and c. keeping the alloys solution at 700° C. to 900° C. under mechanical or electromagnetic agitation and performing casting molding.

Preferably, the aluminum-zirconium-carbon (Al—Zr—C) intermediate alloy has a chemical composition of 0.1% to 10% Zr, 0.01% to 0.3% C, and Al in balance. A more preferable chemical composition is: 1% to 5% Zr, 0.1% to 0.3% C, and Al in balance.

Preferably, the contents of impurities in the aluminum-zirconium-carbon (Al—Zr—C) intermediate alloy are: Fe of no more than 0.5%, Si of no more than 0.3%, Cu of no more than 0.2%, Cr of no more than 0.2%, and other single impurity element of no more than 0.2%, based on weight percentage.

Preferably, the zirconium metal (Zr) in the step a is zirconium scarp or zirconium powder having an average particle size of 0.1 mm to 1 mm Preferably, the graphite powder has an average particle size of 0.335 mm to 1 mm Preferably, the graphite powder has an average particle size of 0.154 mm to 0.335 mm Preferably, the aqueous solution of KF, NaF, $K_2ZrF_6$, $K_2TiF_6$ or the combination thereof has a concentration of 0.1 g/L to 5 g/L.

Preferably, when the graphite powder is soaked, the aqueous solution has a temperature of 50° C. to 100° C.

Preferably, the zirconium and the treated graphite powder are added in step b in the order of: firstly the zirconium, and secondly the treated graphite powder after the zirconium being completely melted; or firstly the treated graphite powder, and secondly the zirconium after the treated graphite powder being completely melted.

Preferably, the casting molding in step c adopts casting and rolling to form wire material having a diameter of 9 to 10 mm The present invention achieves the following technical effects: graphite can be completely melt in aluminum liquid having relatively low temperature (900° C. or lower) by selecting graphite powder having an appropriate particle size and soaking the same in appropriate solutions, which addresses not only the problem about the tendency of aluminum liquid to be oxidized at a high temperature of 1000° C. or higher, but also the problem about the melting and incorporating of graphite, providing high-quality aluminum-zirconium-carbon (Al—Zr—C) intermediate alloy; and the present method has the advantages of broad sources of raw materials, simple process, low producing cost, and large-scale production.

DETAILED DESCRIPTION OF THE PREFERRED EMBODIMENT

The present invention can be further clearly understood in combination with the particular examples given below, which, however, are not intended to limit the scope of the present invention.

Example 1

Commercially pure aluminum, zirconium scarp and graphite powder were weighed in a weight ratio of 96.85% Al, 3% Zr, and 0.15% C. The graphite powder had an average particle size of 0.27 mm to 0.83 mm The graphite powder was soaked in 2 g/L KF aqueous solution at 65±3° C. for 24 hours, filtrated to remove the solution, dried at 120±5° C. for 20 hours, and then cooled to room temperature for use. Aluminum was added to an induction furnace, melt, and heated to a temperature of 770±10° C., in which the zirconium scarp and the soaked graphite powder were sequentially added and completely dissolved under agitation. The resultant mixture was kept at the temperature, continuously and mechanically agitated to be homogenized, and then processed by casting and rolling into coiled wires having a diameter of 9.5 mm

Example 2

Commercially pure aluminum, zirconium scarp and graphite powder were weighed in a weight ratio of 95.6% Al, 4.2% Zr, and 0.2% C. The graphite powder had an average particle size of 0.27 mm to 0.55 mm The graphite powder was soaked in 0.5 g/L $K_2TiF_6$ aqueous solution at 90±3° C. for 36 hours, filtrated to remove the solution, dried at 100±5° C. for 24 hours, and then cooled to room temperature for use. The aluminum ingot was added to an induction furnace, melt, and heated to a temperature of 870±10° C., in which the zirconium scarp and the soaked graphite powder were sequentially added and completely dissolved under agitation. The resultant mixture was kept at the temperature, continuously and electromagnetically agitated to be homogenized, and then processed by casting and rolling into coiled wires having a diameter of 9.5 mm

Example 3

Commercially pure aluminum, zirconium scarp and graphite powder were weighed in a weight ratio of 98.9% Al, 1% Zr, and 0.1% C. The graphite powder had an average particle size of 0.15 mm to 0.25 mm The graphite powder was soaked in 0.3 g/L $K_2TiF_6$ aqueous solution at 70±3° C. for 48 hours, filtrated to remove the solution, dried at 170±5° C. for 12 hours, and then cooled to room temperature for use. The aluminum ingot was added to an induction furnace, melt, and heated to a temperature of 730±10° C., in which the soaked graphite powder and the zirconium scarp were sequentially added and completely dissolved under agitation. The resultant mixture was kept at the temperature, continuously and mechanically agitated to be homogenized, and then processed by casting and rolling into coiled wires having a diameter of 9.5 mm

Example 4

Commercially pure aluminum, zirconium scarp and graphite powder were weighed in a weight ratio of 97.2% Al, 2.5% Zr, and 0.3% C. The graphite powder had an average particle size of 0.08 mm to 0.12 mm. The graphite powder was soaked in 4.5 g/L NaF aqueous solution at 55±3° C. for 72 hours, filtrated to remove the solution, dried at 140±5° C. for 22 hours, and then cooled to room temperature for use. The aluminum ingot was added to an induction furnace, melt, and heated to a temperature of 830±10° C., in which the soaked graphite powder and the zirconium scarp were sequentially added and completely dissolved under agitation. The resultant mixture was kept at the temperature, continuously and mechanically agitated to be homogenized, and then processed by casting and rolling into coiled wires having a diameter of 9.5 mm

Example 5

Commercially pure aluminum, zirconium scarp and graphite powder were weighed in a weight ratio of 90.0% Al, 9.7% Zr, and 0.3% C. The graphite powder had an average particle size of 0.27 mm to 0.83 mm The graphite powder was soaked in 4 g/L KF aqueous solution at 95±3° C. for 48 hours, filtrated to remove the solution, dried at 160±5° C. for 20 hours, and then cooled to room temperature for use. The aluminum ingot was added to an induction furnace, melt, and heated to a temperature of 720±10° C., in which the zirconium scarp and the soaked graphite powder were sequentially added and completely dissolved under agitation. The resultant mixture was kept at the temperature, continuously and mechanically agitated to be homogenized, and then processed by casting and rolling into coiled wires having a diameter of 9.5 mm Example 6

Commercially pure aluminum, zirconium scarp and graphite powder were weighed in a weight ratio of 99.87% Al, 0.1% Zr, and 0.03% C. The graphite powder had an average particle size of 0.27 mm to 0.55 mm The graphite powder was soaked in a mixed aqueous solution of 1.2 g/L $K_2TiF_6$ and 0.5 g/L KF at 87±3° C. for 36 hours, filtrated to remove the solution, dried at 110±5° C. for 20 hours, and then cooled to room temperature for use. The aluminum ingot was added to an induction furnace, melt, and heated to a temperature of 810±10° C., in which the zirconium scarp and the soaked graphite powder were sequentially added and completely dissolved under agitation. The resultant mixture was kept at the temperature, continuously and mechanically agitated to be homogenized, and then processed by casting and rolling into coiled wires having a diameter of 9.5 mm Example 7

Mg-5% Al alloy was melt in an induction furnace under the protection of a mixture gas of $SF_6$ and $CO_2$, and heated to a temperature of 740° C., to which 1% Al—Zr—C intermediate alloy prepared according to example 1 was added to perform grain refining. The resultant mixture was kept at the temperature under mechanical agitation for 30 minutes, and directly cast into ingots.

The Mg-5% Al alloy before and after grain refining were analyzed and compared under scanning electron microscope. A measurement was made by cut-off point method under GB/T 6394-2002, providing an average diameter of grains of 150 μm for the unrefined Mg-5% Al alloy, and an average diameter of grains of 50 μm for the refined Mg-5% Al, both under the same conditions. The test results indicate that the Al—Zr—C intermediate alloy according to the present invention has very good grain refining effect for magnesium alloys.

What is claimed is:

1. A method for producing an aluminum-zirconium-carbon intermediate alloy, characterized in that the aluminum-zirconium-carbon intermediate alloy has a chemical composition of 0.01% to 10% Zr, 0.01% to 0.3% C, and Al in balance, based on weight percentage;

the producing method comprising the steps of:

a. producing commercially pure aluminum, zirconium metal, and graphite material according to the weight percentages of the aluminum-zirconium-carbon intermediate alloy; the graphite is graphite powder having an average particle size of 0.074 mm to 1 mm; and the graphite powder is subjected to the following treatments: being added to an aqueous solution of KF, NaF, $K_2ZrF_6$, $K_2TiF_6$ or a combination thereof, soaked for 12 to 72 hours, filtrated or centrifuged, and dried at 80° C. to 200° C. for 12 to 24 hours;

b. melting the commercially pure aluminum and keeping it at 700° C. to 900° C. to provide aluminum liquid, in which a prepared zirconium and the treated graphite powder are added and melted to provide an alloy solution; and c. keeping the alloy solution at 700° C. to 900° C. under mechanical or electromagnetic agitation and performing casting molding.

2. The method for producing an aluminum-zirconium-carbon intermediate alloy according to claim 1, wherein the contents of impurities present in the aluminum-zirconium-carbon intermediate alloy are: Fe of no more than 0.5%, Si of no more than 0.3%, Cu of no more than 0.2%, Cr of no more than 0.2%, and other single impurity element of no more than 0.2%, based on weight percentage.

3. The method for producing an aluminum-zirconium-carbon intermediate alloy according to claim 1, wherein the zirconium metal in the step a is zirconium scrap or zirconium powder having an average particle size of 0.1 mm to 1 mm.

4. The method for producing an aluminum-zirconium-carbon intermediate alloy according to claim 1, wherein the graphite powder has an average particle size of 0.335 mm to 1 mm.

5. The method for producing an aluminum-zirconium-carbon intermediate alloy according to claim 1, wherein the graphite powder has an average particle size of 0.154 mm to 0.335 mm.

6. The method for producing an aluminum-zirconium-carbon intermediate alloy according to claim 1, wherein the aqueous solution of KF, NaF, $K_2ZrF_6$, $K_2TiF_6$ or the combination thereof has a concentration of 0.1 g/L to 5 g/L.

7. The method for producing an aluminum-zirconium-carbon intermediate alloy according to claim 1, wherein when the graphite powder is soaked, the aqueous solution has a temperature of 50° C. to 100° C.

8. The method for producing an aluminum-zirconium-carbon intermediate alloy according to claim 1, wherein the zirconium and the treated graphite powder are added in step b in the order of:

firstly the zirconium, and secondly the treated graphite powder after the zirconium being completely melted; or firstly the treated graphite powder, and secondly the zirconium after the treated graphite powder being completely melted.

9. The method for producing an aluminum-zirconium-carbon intermediate alloy according to claim 1, wherein the casting molding in step c adopts casting and rolling to form wire material having a diameter of 9 to 10 mm.

10. The method for producing an aluminum-zirconium-carbon intermediate alloy according to claim 2, wherein the zirconium metal in the step a is zirconium scrap or zirconium powder having an average particle size of 0.1 mm to 1 mm.

11. The method for producing an aluminum-zirconium-carbon intermediate alloy according to claim 2, wherein the graphite powder has an average particle size of 0.335 mm to 1 mm.

12. The method for producing an aluminum-zirconium-carbon intermediate alloy according to claim 2, wherein the graphite powder has an average particle size of 0.154 mm to 0.335 mm.

13. The method for producing an aluminum-zirconium-carbon intermediate alloy according to claim 2, wherein the aqueous solution of KF, NaF, $K_2ZrF_6$, $K_2TiF_6$ or the combination thereof has a concentration of 0.1 g/L to 5 g/L.

14. The method for producing an aluminum-zirconium-carbon intermediate alloy according to claim 2, wherein when the graphite powder is soaked, the aqueous solution has a temperature of 50° C. to 100° C.

15. The method for producing an aluminum-zirconium-carbon intermediate alloy according to claim 2, wherein the zirconium and the treated graphite powder are added in step b in the order of: firstly the zirconium, and secondly the treated graphite powder after the zirconium being completely melted; or firstly the treated graphite powder, and secondly the zirconium after the treated graphite powder being completely melted.

16. The method for producing an aluminum-zirconium-carbon intermediate alloy according to claim 2, wherein the casting molding in step c adopts casting and rolling to form wire material having a diameter of 9 to 10 mm.

* * * * *